US005555535A

United States Patent [19]

Davis

[11] Patent Number: 5,555,535

[45] Date of Patent: Sep. 10, 1996

[54] WATCH DIAL

[76] Inventor: Gerard D. Davis, 314 E. 18th St., New York, N.Y. 10003

[21] Appl. No.: 275,713

[22] Filed: Jul. 19, 1994

[51] Int. Cl.[6] ..... G04B 19/06

[52] U.S. Cl. ..... 368/232; 368/80

[58] Field of Search ..... 368/228, 232, 368/280–282, 278, 276, 80

[56] References Cited

U.S. PATENT DOCUMENTS

| | | | |
|---|---|---|---|
| 1,847,800 | 3/1932 | Weil | 368/228 |
| 3,786,627 | 1/1974 | Takagi et al. | 368/232 |
| 3,793,824 | 2/1974 | Simon-Vermont et al. | 368/232 |
| 3,863,439 | 2/1975 | Kasai et al. | 368/232 |
| 4,711,586 | 12/1987 | Kizawa | 368/232 |

FOREIGN PATENT DOCUMENTS

| | | | |
|---|---|---|---|
| 445969 | 4/1936 | United Kingdom | 368/232 |
| 459678 | 1/1937 | United Kingdom | 368/280 |

*Primary Examiner*—Bernard Roskoski
*Attorney, Agent, or Firm*—Lowe, Price, Leblanc & Becker

[57] ABSTRACT

A watch dial which is made by laminating a cut section of a Tagua nut to a watch dial base plate. The cut section of the Tagua nut has a unique grain pattern which can be enhanced by dying or staining. A wide variety of grain patterns and color combinations can be achieved to provide one-of-a-kind watch dials.

18 Claims, 2 Drawing Sheets

WATCH DIAL

TECHNICAL FIELD

The present invention relates to dial plates for timepieces. More particularly, the present invention relates to dial plates for timepieces which have unique aesthetic characteristics.

BACKGROUND ART

Conventional dial plates for timepieces such as watches, wrist watches, bracelet watches, pendant watches, finger ring watches, and the like, generally are made from a metal plate which has a finish coat of paint or a plating material.

The dial of a timepiece is the prominent element of a timepiece which is most often viewed by the wearer and others. Accordingly, dial plates of various patterns and colors have been provided heretofore. However, the coloring of watch dial plates provides limited variations in pattern and color.

A few watch designers have proposed alternatives to colored metal dial plates. For example, U.S. Pat. No. 3,863,439 to Kasai et al discloses a watch dial which has metal crystal in the outer surface which metal crystals are large enough to be seen by the naked eye.

U.S. Pat. No. 3,793,824 to Simon-Vermot et al discloses a watch dial which is made from a synthetic semiprecious stone material. This patent also discusses prior art watch dials which were made from semiprecious stones and minerals or gems.

U.S. Pat. No. 3,786,627 to Takagi et al discloses a watch dial which is made from a laminate that includes a thin shell plate.

In view of the importance of the aesthetic characteristics of watch dials, any enhancement of the appearance of a watch dial can contribute to the demand of watch.

DISCLOSURE OF THE INVENTION

It is accordingly one object of the present invention to provide a watch dial that is made from a novel material which provides for a unique appearance.

Another object of the present invention is to provide a watch dial that is made from a environmentally sound material.

A further object of the present invention is to provide a watch dial which is made from a cut section of a Tagua nut.

A further object of the present invention is to provide a method of making a watch dial from a novel material which provides for a unique appearance.

According to these and other objects of the present invention which will become apparent as the description thereof proceeds, the present invention provides a watch dial which includes a base plate having means to attach the base plate to a watch movement, and a watch dial face laminated to an upper surface of the base plate, wherein the watch dial face comprises a cut section of a Tagua nut. The base plate is preferably made from a metal such as brass.

The base plate and watch dial face are preferably circular and the watch dial face can include one or more time marking indicia on an upper face thereof which can be a raised time marking element.

The watch dial face is preferably colored by staining or dying the watch dial face.

The present invention further provides an improvement over existing timepieces which include a watch dial and a mechanical for moving at least an hour and a minute hand across a surface of watch dial. The improvement involves making the watch dial from a cut section of a Tagua nut, which can be dyed or stained to a desired color and provided with time marking indicia on an upper face thereof. The time marking indicia can include raised time marking elements. Alternatively, it is not necessary to include any time marking indicia on the watch dial.

The present invention further provides a method of making a watch dial which involves providing a watch dial base plate, and laminating a cut section of a Tagua nut to the watch dial base plate. According to the method, the cut section of Tagua nut can be colored as desired by dying or staining.

According to the method, the watch dial base plate is provided with means to attach the watch dial base plate to a watch movement having spindles for rotating at least and hour and a minute hand. The watch dial base plate is attached to the watch movement and at least an hour and a minute hand are attached to the spindles of the watch movement so that the watch movement moves the hour hand and minute hand across a surface of the cut section of Tagua nut.

BRIEF DESCRIPTION OF DRAWINGS

The present invention will be described with reference to the attached drawings which depict non-limiting embodiments of the present invention, in which.

FIGS. *3a–3h* are photographs of the watch dial faces according to the present invention.

Figure 1:
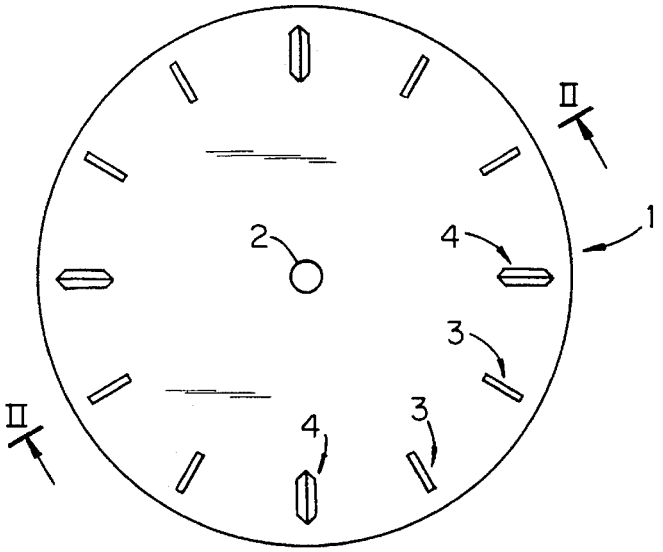
FIG. 1 is a top view of a watch dial plate according to one embodiment of the present invention.
Figure 4:
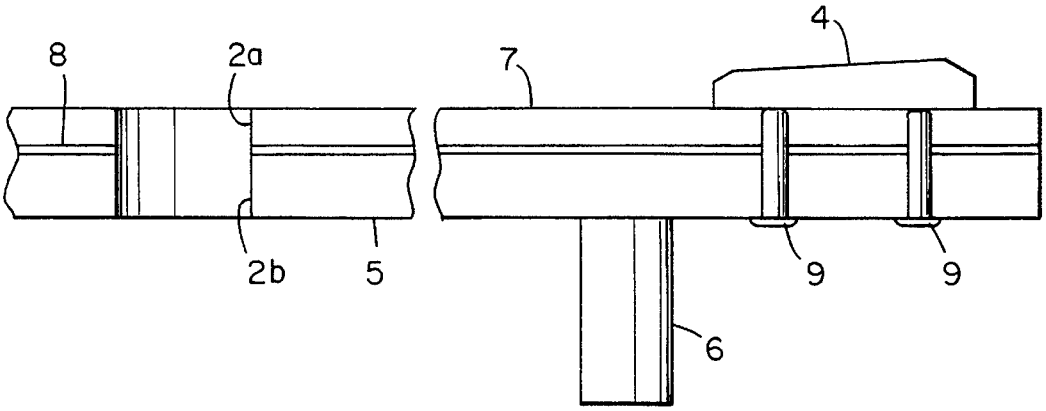
Figure 3A:
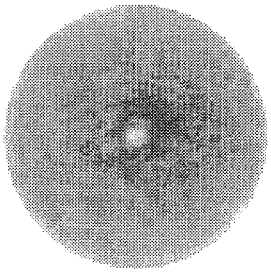
Figure 3B:
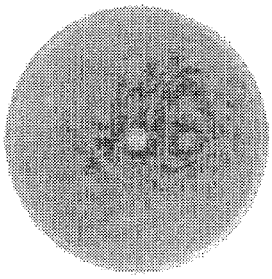
Figure 3C:
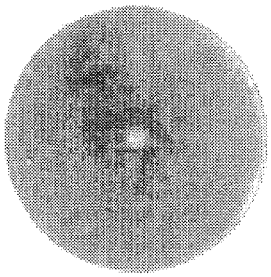
Figure 3D:
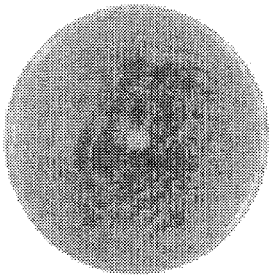
Figure 3E:
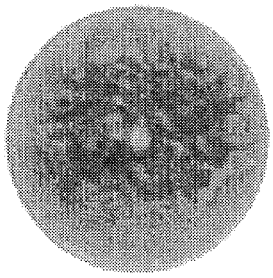
Figure 3F:
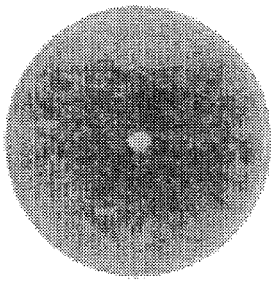
Figure 3G:
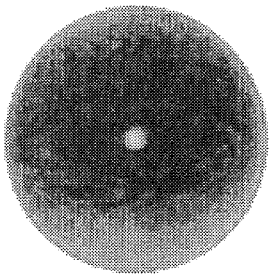
Figure 3H:
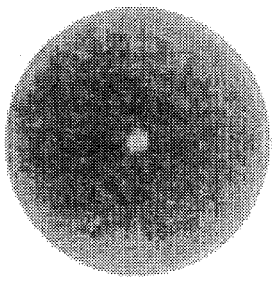

FIG. 4 is a cross sectional view of the watch dial of FIG. 1 which shows how raised time markings can be mechanically attached to the watch dial.

BEST MODE FOR CARRYING OUT THE INVENTION

The present invention is directed to a watch dial which is made from a particular material which provides for a unique appearance when processed according to the present invention. The material is a naturally occurring material which has properties and characteristics which make it particularly suitable for use as a watch dial, including its ability to be machined, dyed or stained, laminated, and polished.

The material used for the watch dial according to the present invention is a specific nut, indigenous to the Amazon Rain Forest, which is referred to as the Tagua nut. The Tagua nut, also referred to as "Vegetable Ivory", has a swirling grain pattern which is unique from nut to nut and throughout each nut. This grain pattern can be visually highlighted and enhanced by dying or staining cut sections of the nut. Thus, according to the present invention, as discussed below, watch dials can be made so that no two are alike in appearance. This is particularly appealing to purchasers who desire a watch or other timepiece which is unique or "one-of-a-kind." There are two specific species of the Tagua nut which have been found to be particularly useful for purposes of the present invention. These include, but are not limited to, the *palandra aequatorialis* species and the *phytelephus seemannii* species.

The present invention involves forming a watch dial by laminating a thin section of a Tagua nut to a metallic base plate. Prior to the lamination process the thin section of the Tagua nut is machined, i.e., cut into a circular disc, sanded, dyed or stained as desired, polished, and sealed. The resulting laminated watch dial is attached to a watch movement which is positioned inside a watch case.

FIG. 1 is a top view of a watch dial according to one embodiment of the present invention. As shown in FIG. 1 the watch dial 1 has a circular shape and is provided with a central hole 2. The central hole 2 in the watch dial 1 is provided to receive the spindles of hour, minute and/or second hands in a conventional manner.

The watch dial 1 can include printed time markings 3 which are provided on the surface thereof. The printed time markings 3 can be printed directly on the surface of the watch dial 1 in a conventional manner. Alternatively, or in combination with printed time markings 3, raised time markings 4 which are made as separate elements can be attached to the surface of the watch dial 1. The raised time markings 4 can be mechanically attached to the watch dial 1 as discussed below in reference to FIG. 2 or attached to the watch dial 1 by means of a suitable cement, epoxy, glue or similar adhesive.

The particular design or style of the printed time markings 3 and/or raised time markings 4 can be selected as desired. In this regard, the printed time markings 3 and/or raised time markings 4 can be of any color. In particular, the raised time markings 4 can be made of any desired material such as metal, stones, gem stones, precious stones, woods, etc. In further embodiments, embossed or engraved time markings can be included in the watch dial.

Figure 2:
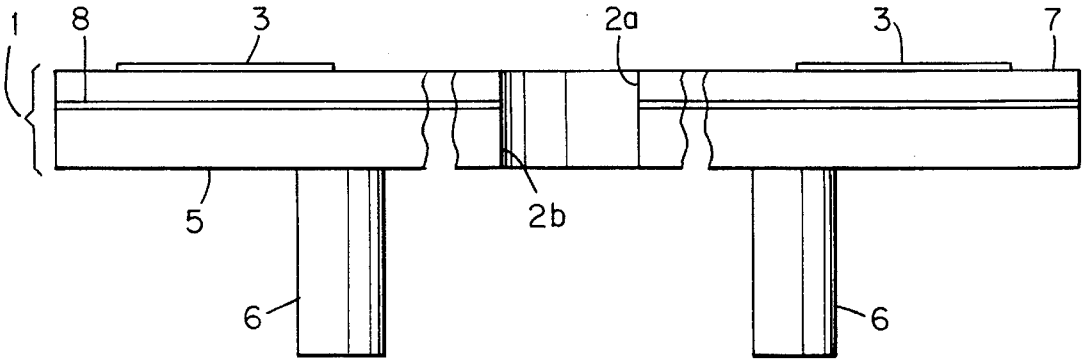
FIG. 2 is a cross sectional view of the watch dial of FIG. 1.

FIG. 2 is a cross sectional view of the watch dial of 1 FIG. 1. As shown in FIG. 2, the watch dial 1 include a base plate 5 which is preferably made of a metal such as brass. The base plate 5 has a circular shape and is provided with a hole 2*b* at the center thereof. The central hole 2*b* in the base plate 5 is provided to receive the spindle is of hour, minute and/or second hands in a conventional manner.

The base plate 5 includes a plurality of legs or pins 6 by which the base plate 5 is attached to a watch movement (not shown) in a conventional manner.

The watch dial 1 of the present invention includes a watch dial face 7 which is laminated to the base plate 5. The watch dial face 7 has a circular shape and is provided with a hole 2*a* at the center thereof. The central hole 2*a* in the watch dial face 7 is provided to receive the spindles of hour, minute and/or second hands in a conventional manner. As shown in FIG. 2, the base plate 5 and watch dial face 7 are complimentarily shaped. In a preferred embodiment which is illustrate in the figures, the base plate 5 and the watch dial face 7 are circular. Alteratively, the base plate 5 and the watch dial face 7 can be square, oval-shaped, polygonal-shaped, or have any geometric or non-geometric shape desired.

According to the present invention, the watch dial face 7 is made from a thin sectional laminate of a Tagua nut which is attached to the base plate 5 by any suitable adhesive, including glues, cements, epoxies, etc, which is exemplified as adhesive layer 8 in FIG. 3.

To fabricate a watch according to the present invention, a thin section of a Tagua nut is obtained by cutting a Tagua nut against its grain. The cut section of the Tagua nut is then attached to a lathe and "turned" to form a circular disc. The circular disc is dyed or stained as desired by contacting the disc with an organic or inorganic dye or stain. Preferable dyes include natural vegetable dyes. The circular disc is contacted by the dye or stain by, any suitable manner including, dipping, spraying, brushing, etc.

The circular disc is sanded to thickness of about 0.4–0.8 mm. Prior to sanding, the cut section of the Tagua nut may be 1–4 mm thick or greater. After the disc is sanded, it is polished and optionally sealed with a oil, polyurethane, varnish, or similar sealing material.

The dyed (of stained) polished disc which forms the watch dial face 7 of the present invention is attached to the base plate 5 by any suitable adhesive, including glues, cements, epoxies, etc. Preferable adhesives include conventional glues. Either after or before lamination of the watch dial face 7 to the base plate 5, printed time markings 3 and/or raised time markings 4 can be provided on the watch dial face 7.

In the case of utilizing mechanical means to attach raised time markings 4 to the watch dial 1, such mechanical means are incorporated after the watch dial face 7 is laminated to the base plate 5. FIG. 4 is a cross sectional view of the watch dial of FIG. 1 which shows how raised time markings 4 can be mechanically attached to the watch dial 1. As seen in FIG. 4, raised time markings 4 are attached to the watch dial 1 by pins or rivets 9 which pass through both the watch dial face 7 and the base plate 5.

After the watch dial face 7 is laminated to the base plate 5 and desired printed time markings 3 and/or raised time markings 4 are added, the resulting watch dial 1 is attached to a watch movement in a conventional manner, and hour, minute and/or second hands are attached to the spindles which pass through the central hole in the watch dial.

FIGS. 3*a*–3*h* are black and white photographs of watch dial faces according to the present invention. FIGS. 3*a*–3*h* illustrate how the appearance of each watch dial face is unique due to the grain patterns of the Tagua nut. These grain patterns are further enhanced by dying or staining the watch dial faces, so that there is an endless variety of grain patterns and colors which can be achieved. Such patterns are not found in any watch dial known to date and provide the owner of the watch with a "one-of-a-kind" watch having a unique appearance.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as described by the claims which follow.

I claim:

1. A watch dial which comprises:

a base plate, including means to attach the base plate to a watch movement; and a watch dial face laminated to an upper surface of said base plate, said watch dial face comprising a cross section of a Tagua nut.

2. A watch dial according to claim 1, wherein said base plate is made from a metal.

3. A watch dial according to claim 1, wherein said base plate and said watch dial face are circular.

4. A watch dial according to claim 1, wherein said watch dial face includes at least one time marking indicia on an upper face thereof.

5. A watch dial according to claim 4, wherein said at least one time marking indicia comprises a raised time marking element.

6. A watch dial according to claim 1, wherein said watch dial face is colored by staining or dying said watch dial face.

7. In a timepiece comprising a watch dial and mechanical movement for moving at least an hour and a minute hand across a surface of said watch dial, the improvement comprising making said watch dial from a cross section of a Tagua nut.

8. A timepiece according to claim 7, wherein said watch dial comprises base plate and a watch dial face made form a Tagua nut which is laminated to said base plate.

9. A timepiece according to claim 8, wherein said base plate and said watch dial face are circular.

10. A timepiece according to claim 8, wherein said watch dial face includes at least one time marking indicia on an upper face thereof.

11. A timepiece according to claim 10, wherein said at least one time marking indicia comprises a raised time marking element.

12. A timepiece according to claim 8, wherein said watch dial face is colored by staining or dying said watch dial face.

13. A method of making a watch dial which comprises providing a watch dial base plate; and laminating a cross section of a Tagua nut to said watch dial base plate.

14. A method of making a watch dial according to claim 13, further comprising coloring said cross section of Tagua nut by dying or staining.

15. A method of making a watch dial according to claim 13, further comprising providing time markings on said cross section of Tagua nut.

16. A method of making a watch dial according to claim 13, further comprising providing said watch dial base plate with means to attach said watch dial base plate to a watch movement.

17. A method of making a watch dial according to claim 16, further comprising attaching said watch dial base plate to a watch movement having spindles for rotating at least and hour and a minute hand.

18. A method of making a watch dial according to claim 17, further comprising attaching at least an hour and a minute hand to said spindles of said watch movement so that said watch movement moves said hour hand and minute hand across a surface of said cross section of a Tagua nut.

* * * * *